US007765615B2

(12) United States Patent
Eastwood et al.

(10) Patent No.: US 7,765,615 B2
(45) Date of Patent: Aug. 3, 2010

(54) CHEST PROTECTOR IN SPORTS MEDICINE

(76) Inventors: Michael Robert Eastwood, 20 Peartree La., Huntington Station, NY (US) 11746; George K Lau, 8 Vista Dr., Syosset, NY (US) 11791; Michael Mangino, 16 Beaumont Dr., Melville, NY (US) 11747; Myles Kobren, 19 Carriage La., Plainview, NY (US) 11803

( * ) Notice: Subject to any disclaimer, the term of this patent is extended or adjusted under 35 U.S.C. 154(b) by 303 days.

(21) Appl. No.: 11/692,541

(22) Filed: Mar. 28, 2007

(65) Prior Publication Data

US 2008/0235855 A1 Oct. 2, 2008

(51) Int. Cl.
*A41B 1/00* (2006.01)

(52) U.S. Cl. ..... 2/115

(58) Field of Classification Search ..... 2/455, 2/2.5, 267, 113, 115, 247, 69, 108, 94
See application file for complete search history.

(56) References Cited

U.S. PATENT DOCUMENTS 4,535,478 A * 8/1985 Zufle ..... 2/2.5
4,660,223 A * 4/1987 Fritch ..... 2/2.5
5,621,914 A * 4/1997 Ramone et al. ..... 2/463
5,640,718 A * 6/1997 Aldridge ..... 2/81
6,371,977 B1 * 4/2002 Bumbarger et al. ..... 607/108
6,485,446 B1 * 11/2002 Brother et al. ..... 602/20
7,171,696 B2 * 2/2007 Falone et al. ..... 2/161.1

* cited by examiner

*Primary Examiner*—Tejash Patel
(74) *Attorney, Agent, or Firm*—Eliot Gerber

(57) ABSTRACT

A chest protector, in sports medicine, adapted for players of the athletic games, is light in weight and reasonably comfortable to wear. It will protect the heart and chest cavity area of players in such games as lacrosse, field hockey, and baseball. The chest protector includes a shirt, preferably of two-way stretch fabric, having a large front pocket across its chest area. A protector plate is positioned within the pocket. The protector plate is an assembly of molded layers, comprising innermost and outer-most layers of plastic, preferably polyethylene sheets; a central layer of a high impact polymer pad, preferably a dry polyurethane gel; and two layers of high impact resistant fabric of high tensile strength fibers, preferably para-aramid fibers, with the polymer pad being sandwiched between the two layers of impact resistant fabric.

15 Claims, 2 Drawing Sheets

CHEST PROTECTOR IN SPORTS MEDICINE

FIELD OF THE INVENTION

The present invention relates to athletic equipment and more particularly to a sports medicine chest protector to protect the chest cavity and heart of players in contact sports, particularly lacrosse.

BACKGROUND OF THE INVENTION

At the present time a number of chest protectors, to protect players during athletic games, are widely used. For example, padded chest protectors are used in baseball, for the catcher, and they are used in lacrosse, field hockey, and in ice hockey for the goal keeper.

However, in many sports, chest protectors are not used because the players must run in order to play the game and they do not want to wear heavily padded garments. This is less of a problem in those sports using large or soft balls. In those sports, such as soccer and basketball, the force of the ball, because it is large, is less likely to cause any damage to the body. However, in some sports the ball or puck is small and hard and may be propelled at high speed. For example, in lacrosse and baseball, the ball is both small and hard and may be thrown and or hit at speeds of between seventy and one hundred miles an hour, even in amateur games.

In the past few years a number of injuries and deaths have resulted when children were hit in the chest by a lacrosse ball. A small number of schools, as a result, have installed automated external defibrillators to revive the child who goes into cardiac arrest from commotio cordis because of a shock to the chest. This program is limited, due to the cost of such defibrillators and the strong possibility that when they are needed neither the defibrillator nor someone trained in its use would be available. A review article, by Doctor Mark Link of the Tufts Medical Center, points out the significant percentage of deaths on the amateur lacrosse field are due to impact to the chest area, causing commotio cordis (sudden cardiac arrest). This problem is most frequently observed in young athletes, ages 4 to 18. The victims are most often suffering from ventricular fibrillation, a fast heartbeat rhythm which is life threatening. The Sport Science and Safety Committee of the U.S. Lacrosse Association has recently found that there are no chest protectors on the market, for lacrosse players, which they approved and which eliminate the risk of dying from chest injury when struck by a lacrosse ball.

The United States patent literature includes various patents and published patent applications directed toward chest protectors in sports. Many of these are suitable for a baseball catcher who does not run around a field when catching pitched baseballs. In U.S. Pat. No. 6,182,299 to Chen, a baseball chest protector includes a pad body and a series of shock absorbent pad blocks. In U.S. Pat. No. 6,519,782 to Collins et al., a baseball chest protector includes an ambient air filled pouch assembly.

Other patents are directed toward chest protectors for the players who normally run while playing. In U.S. Pat. No. 5,769,688 to Holliday, a bra-like chest protector for women athletes comprises a soft foam exterior and a hard, high density plastic internal breast plate. In U.S. Pat. No. 5,325,537 to Marion, an internal breast plate athletic safety jacket has a circular plate over the heart area.

In U.S. Pat. No. 3,500,472 to Castellania, a sleeveless chest protector has pockets holding inflatable cushions. U.S. Pat. No. 4,610,035 to Mattila, relates to an upper body protector having semi-rigid chest and shoulder portions. U.S. Pat. No. 5,950,249 to Clemet discloses a chest protector having a plastic cap-like shaped plate attached to a rubber pad which protrudes from a soft terry cloth pocket. In U.S. Pat. No. 5,325,537 to Marioa an athletic jacket has rigid compressed, dense plastic foam pieces and a rigid hard shield over the heart.

SUMMARY OF THE INVENTION

The present invention relates to a light-weight chest protector, in sports medicine, which is sufficiently light in weight and comfortable to wear so that it would be willingly worn by children and others when they play running sports, such as lacrosse. A chest protector plate fits snugly in a special large front pocket of a special shirt. The shirt is of a suitable plastic resin fabric, preferably a two way stretch fabric, such as "CyberKnit"™ (of Paul Gottlieb and Co.) The shirt is washable and wicks moisture away from the player's body. For example, the shirt's fabric may be made from polyester and polypropylene fibers.

The "chest protector" is the combination of the shirt and the chest protector plate. The shirt and the plate come in a number of sizes, i.e. child, small, medium and large in order to fit various players, with the size of the protector plate conforming to the size of the shirt.

In one preferred embodiment, the chest protector plate is molded, to curve like an average chest. The protector plate has inner-most and outer-most layers each of a plastic sheet, preferably low density polyethylene. The two plastic sheets are molded together to form an air tight pocket which encloses the other layers of the plate. In order, starting with the out-most layer (with respect to the players chest) the other layers are an impact resistant fabric of high tensile strength fibers, preferably "Kevlar"™ (DuPont); a layer of high impact polymer pad which disperses impact energy throughout the pad, the pad being preferably a visoelectric dry polymer, and most preferably a hybrid polyurethane elastomer and a second layer of the impact resistant fabric of high tensile strength fibers. The polymer pad is sandwiched between the two layers of high impact resistant fabric. The five layers are bonded and laminated together to form a unitary thin and lightweight protector plate.

The chest protector of the present invention is especially useful in some sports, such as lacrosse and baseball. However, it is sufficiently light and comfortable so that it may be worn to protect players, particularly children, in other sports including soccer, field hockey, softball and touch football.

Although the preferred way to position the chest protector plate is to enclose it within a large front shirt pocket which is across the width to the shirt, although the 'shirt' may be a separate pocket held by straps on the chest of the player.

BRIEF DESCRIPTION OF THE DRAWING

The following detailed description of the invention should be taken in conjunction with the accompanying drawing. In the drawing.

DETAILED DESCRIPTION OF THE INVENTION

Figure 1:
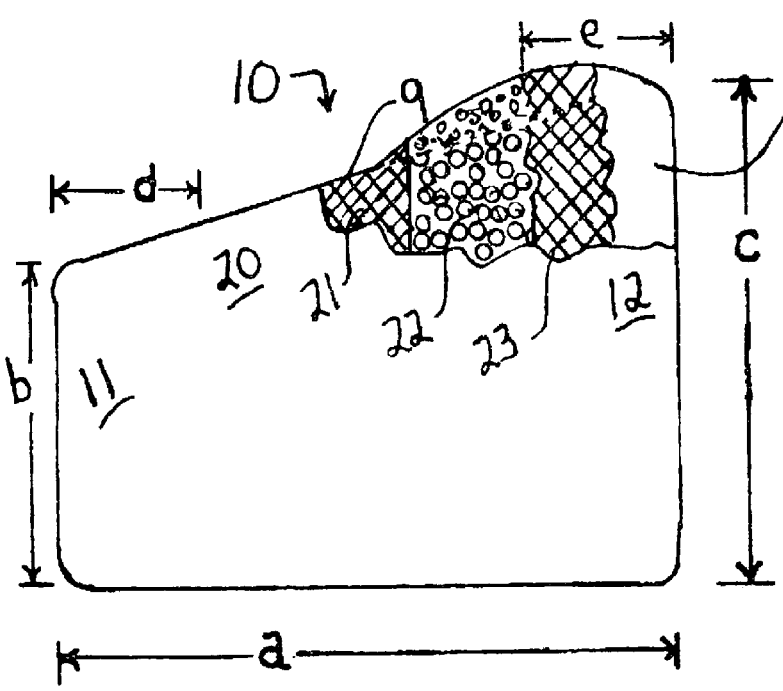
FIG. 1 is a front plan view of the chest protector plate, partly broken away.

As shown in FIG. 1, the chest protector plate 10 is large enough to cover the heart and chest cavity area of the average sports player. Preferably the plate 10 is made in various sizes, for example child, small, medium, and large. The plate 10 has a central section 9 and curved left and curved right side flanges (as seen from the front) respectfully 11 and 12. The plate is taller on the left side than on the right side.

In one prototype, which is a non-limiting example of the present invention, the chest protector plate is of a size suitable for a medium size player, about 120-160 pounds (adult male). It is 13½ inches (34.3 cm) wide ("a" in FIG. 1); its height at the left side ("b" in FIG. 1) is 6½ inches (16.5 cm); its height at the right side ("c" in FIG. 1) is 10½ inches (26.7 cm); and its total thickness (except at its edges) is ⅜ inches (0.95 cm). The corners of the plate are rounded. The curvature of the plate 10 is a 2 inches curvature to the chest, and the curved right 11 and left flanges have a curvature having a radius of 7 inches (17.8 cm). The central section 9, also has a slight curvature which is bowed outwardly with respect to the chest. The central section 9 is 7 inches (17.8 cm) wide and the left 12 ("d" in FIG. 1) and right 13 ("E" in FIG. 1) flanges are each 6¼ inches (15.87 cm) wide.

Figure 4:
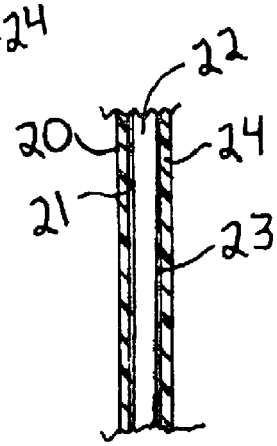
FIG. 4 is an enlarged side view of a cross section of the chest protector plate.

As shown in FIG. 4, the outer-most layer 20, and the inner-most layer 24, are of high impact, low density polyethylene having preferably a thickness of 1/16 inch (1.6 cm) and in the range of 1/32 inch to ¼ inch, before they are vacuum formed.

The layers 21 and 23 are of a cross woven, flexible cloth of high impact material. Preferably the cloth is woven of "Kevlar"™ (DuPont), for its para-aramide fiber, although alternatively the cloth may be woven of "Kevlar"™ (DuPont) and carbon graphite filaments or only of carbon graphite filaments. "Kevlar"™ (DuPont) is said to be poly-p-phenyleneterephtalamide and the preferred fabric material, is 5 oz. per square yard and 0.01 inches (0.25 cm) thick. It is a high tensile strength fiber.

The second layer, 22, is a layer of a flexible, dense, and impact resistant plastic resin material, (high impact polymer padding), preferably ¼ inch thick (6.35 cm) and the range ⅛ to ½ inch, of hybrid polyurethane elastomer dense foam most preferably "Shock Tec" brand, specifically Shock Tec Air 2HD™ (Kemmler Products, Mooresville, N.C.).

The layer 22, is sandwiched between the high tensile strength fabric layers, 21 and 23. Technically, the material of the preferred polymer pad need is not a 'foam', but rather a hybrid polyurethane elastomer (visoelectric dry polymer). An alternative polymer pad is high density foam of EVA.

In one alternative, not shown in the drawing nor used in the tests described below, the polymer pad, such as a foam layer, may be impregnated with a plastic resin, semi-liquid gel, preferably a liquid urethane elastomer gel, to increase its resistance to deformation from projectile impacts.

Although the shirt may be a simple T-shirt, which may be short-sleeved or sleeveless, it may also be a long-sleeved shirt. The shirt may come in a various colors and sizes and have arm and shoulder pockets to hold additional protector plates. Alternatively, pocket 2 for the chest protector plate may be formed of cloth, or other sheet material, and held on the chest by straps. The term "shirt" as used herein, means any garment or device having a pocket, or plate holder which is at least over the heart, and preferably which is across the entire chest area.

Figure 3:
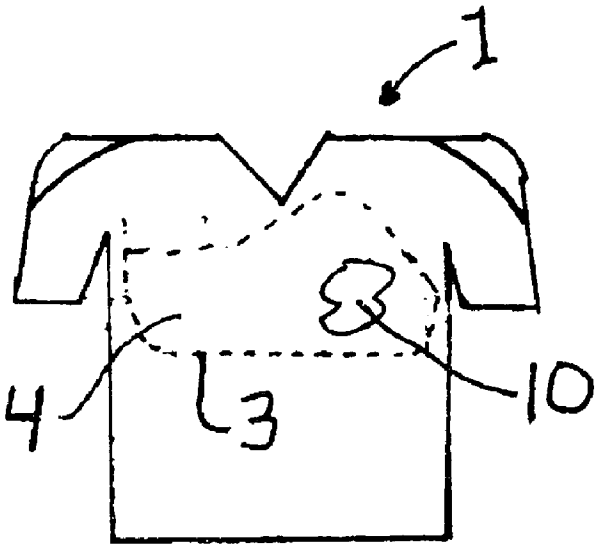
FIG. 3 is a front plan view of the shirt, partly cut away, showing its enclosed chest protector plate.
Figure 2:
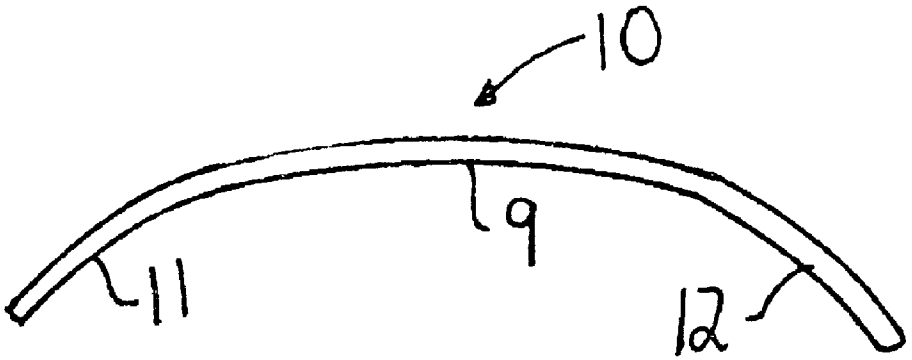
FIG. 2 is a top plan view of the chest protector plate.

As shown in FIG. 3, the shirt, 1, is a T-shirt with sleeves. The shirt, 1, has a pocket, 2, which is formed by a cloth piece being sewn to the front of shirt, 1 by line of sewing 3 (dotted line). The pocket extends across the front chest area of shirt 1. The pocket and its enclosed protector plate, cover the heart and chest cavity of the player. As shown in FIG. 2, the protector plate 10 central section, 9, is slightly bowed outward and its left and right side proportions (flaps), 11 and 12, are curved to fit an average player.

The prototype of the protector plate used in the below described tests was formed by laminating the layers within an envelope of heated plastic and shaped in a vacuum forming mold. However, other manufacturing methods may be used.

The tests were conducted by projecting a small hard ball at a dummy and measuring the impact results on the dummy with, and without, the chest-protector plate. The dummy was not a crash test dummy, as used in the automobile manufacturing industry, but simply a thickness i.e. 57.1 mm thick, of homogenous, dense clay on a support.

The first test involved an official hard baseball and a pitching machine which threw the ball at a speed of about 62 miles per hour, from a distance of 22 feet, at the target dummy. The average depth of penetration (how deep a hole the ball made in the clay dummy) was 35.3 mm without the protector plate, and 6 mm with the protector plate. At a distance of 10 feet, under the same conditions, the average depth of penetration, without the protective plate was 40.3 mm. With the protective plate, the average depth of penetration was 6.5 mm. In both these series of tests, the protector plate reduced the depth of penetration by more than 80 percent.

The third test used a 3 ounce street hockey ball, which is the same size as a lacrosse ball. It was mounted on the end of a shaft and the shaft was projected using an accurate long bow (40 lbs.) having a muzzle velocity of 153 fps. The target (same size clay dummy) was set at 10 feet from the ball's initial position. Sixty samples were run (30 unprotected, 30 protected). The ball was projected at 103 miles per hour (based on muzzle velocity). The average depth of penetration for the unprotected clay dummy was 27.6 mm and the average depth was 4.95 mm for the dummy with the protective plate. This was an 83.8 percent reduction in the shock effect.

Although the theory of operation is not necessary to practice the present invention, the following is presented as informed speculation:

The outer layer (away from the chest) of the woven impact resistant "Kevlar"™ (DuPont) prevents the mass of the projectile ball or puck from penetration through to the player's chest. The polymer pad (polyurethane elastomer gel) has excellent shock dispersment properties and greatly reduces the shock from the projector. The back inner layer of woven impact resistant material provides a safety measure against the projectile completely penetrating the projector plate. The outer-most and inner-most sheets of plastic form an air tight pocket which traps air as a cushion pillow to blunt the effect of the forward edge of the projectile.

The term "high tensile strength fiber" means the maximum tensile stress (nominal) sustained the fiber filaments during a tension test and is at least 3.0 Gpa.

The preferred material is "Kevlar 49" [para-aramid fibers] ™ (DuPont) having a density of 1.44 g, 1 cm; tensile modules of 131 Gpa; tensile strength of 3.6-4.1 Gpa and tensile elongation of 2.8 percent. The term "high impact resistant polymer padding" means high impact resistant dense polymer foams with a density of at least 10 lbs/in.sup.3) and visoelectric dry elastomers. The term "gel" does not refer, when used with the term visoelectric dry polymer, to a flowable liquid, but rather, to a dense, dry foam-like sheet.

When a projectile hits the high impact resistant polymer pad, its force is spread out and dissipated throughout the entire layer of the polymer pad. The polymer pad is defined as being, preferably, a pad that will not compress more than 70 percent of its original thickness at the point of impact regardless of the force of impact.

The invention claimed is:

1. A chest protector in sports medicine to protect a player against injury from high speed sport projectiles, such as balls or pucks, and not bullets, comprising: a shirt having a front area and adapted to be worn by the player, a pocket formed on the shirt and extending sufficiently across the width of the shirt front area to cover the heart of the player; a chest protector plate within the pocket; the chest protector plate being an assembly of the following layers; not more than two layers of a penetration resistant woven fabric of high tensile strength para-aramid fibers and a layer of high impact resistant polymer pad which is a dense dry foam-like sheet of visoelectric polyurethane gel and which is impact resistant and dissipates impact force throughout the polymer pad, the said polymer pad being interior of the said fabric layer with respect to the chest of the player.

2. A chest protector as in claim 1, wherein the chest protector plate has inner-most and outer-most layers of plastic sheets selected from the group of low density polyethelene, polypropylene and ABS.

3. A chest protector as in claim 2, wherein the inner-most and outer-most layers are molded together to form an air tight pocket enclosing the other layers.

4. A chest protector as in claim 1, wherein the protector plate includes two layers of a penetration resistant woven fabric of high tensile strength para-aramid fibers; the polymer pad being sandwiched between the two layers of penetration resistant woven fabric.

5. A chest protector as in claim 1, wherein the shirt is a two way stretch fabric including elastic fibers and having moisture wicking properties.

6. A chest protector, as in claim 1, wherein, the shirt includes polypropylene fibers.

7. A chest protector as in claim 1, wherein, the pocket and the protector plate extend across the width of the shirt's front area.

8. A chest protector as in claim 1, wherein the protector plate has curved side flanges, as seen from above, when worn by the player.

9. A chest protector as in claim 1, wherein as seen from above, when worn by the player, the protector plate has a bowed-outward center section and opposite curved side flanges.

10. A chest protector in sports medicine to protect a player against injury from high speed projectiles, such as balls and pucks, the chest protector, which is not a bulletproof vest, comprising: a shirt adapted to be worn by the player with the shirt having a front chest area, a pocket formed on the shirt and extending sufficiently across the width of the shirt front area to cover the heart of the player; a chest protector plate within the pocket, the chest protector plate being an assembly of the following layers, in the order named, starting with the furthermost outer-most layer with respect to the player's chest; a. the first layer is a moldable sheet of polyethylene plastic b. the second layer is a layer of penetration resistant woven fabric of high tensile strength para-aramid fibers, c. the third layer is a high impact polymer pad, which is a dense dry foam-like sheet of viscoelectric polyurethane pad and which is impact resistant and dissipates impact force throughout the polymer pad, d. the fourth layer is a layer of penetration resistant woven fabric of high tensile strength para-aramid fibers, and e. the fifth layer, closest to the player's chest, is a moldable sheet of polyethylene plastic.

11. A chest protector as in claim 10, wherein the first and fifth layers are molded together to form an air-tight pocket, enclosing the second and third layers.

12. A chest protector as in claim 10, wherein the shirt is a two way stretch fabric including elastic fibers and having moisture wicking properties.

13. A chest protector, as in claim 10, wherein the shirt includes polypropylene fibers.

14. A chest protector as in claim 10, wherein the pocket and the protector plate extend across the width of the shirt's front area.

15. A chest protector as in claim 10, wherein the protector plate has curved side flanges, as seen from above when worn by the player.

* * * * *